US012582193B2

(12) United States Patent
Tillman

(10) Patent No.: US 12,582,193 B2
(45) Date of Patent: Mar. 24, 2026

(54) TOE WALKING PREVENTION DEVICE

(71) Applicant: 2 Steps Ahead LLC, Owens Cross Roads, AL (US)

(72) Inventor: Jessica Tillman, Owens Cross Roads, AL (US)

( * ) Notice: Subject to any disclaimer, the term of this patent is extended or adjusted under 35 U.S.C. 154(b) by 0 days.

(21) Appl. No.: 18/784,743

(22) Filed: Jul. 25, 2024

(65) Prior Publication Data

US 2024/0373977 A1 Nov. 14, 2024

Related U.S. Application Data

(63) Continuation-in-part of application No. 18/080,572, filed on Dec. 13, 2022, now abandoned.

(51) Int. Cl.
*A43B 13/14* (2006.01)
*A43B 7/145* (2022.01)

(52) U.S. Cl.
CPC ..... *A43B 13/145* (2013.01); *A43B 7/145* (2013.01)

(58) Field of Classification Search
CPC ..... A43B 13/145; A43B 7/145; A43B 17/00; A43B 17/12; A43B 17/14; A43B 17/006; A61F 5/0102; A61F 5/0111; A61F 5/019
See application file for complete search history.

(56) References Cited

U.S. PATENT DOCUMENTS 1,163,490 A * 12/1915 Weil ..... A61F 5/019 132/73
1,295,611 A * 2/1919 Schwartz ..... A61F 5/019 200/16 R
1,787,398 A * 12/1930 Sidgreaves ..... A61F 5/019 602/30
2,036,770 A * 4/1936 Owens ..... A61B 17/00 602/30
2,057,922 A * 10/1936 Scholl ..... A61F 13/063 128/894
2,066,443 A * 1/1937 Adams ..... A61F 5/019 602/30
2,095,664 A * 10/1937 Grenfell ..... A61F 5/019 602/30
2,163,012 A * 6/1939 Schenk ..... A61F 13/063 63/15
2,531,851 A * 11/1950 Kiwad ..... A43B 7/26 132/73
2,593,767 A * 4/1952 Kiwad ..... A61F 5/019 132/73
2,636,491 A * 4/1953 La Bille ..... A61F 5/019 602/30
2,663,296 A * 12/1953 Morgan ..... A61F 13/068 128/894

(Continued)

FOREIGN PATENT DOCUMENTS

GB 664800 A * 1/1952 ..... A61F 13/063
GB 843658 A * 8/1960 ..... A61F 5/019

*Primary Examiner* — Heather Mangine
*Assistant Examiner* — Raquel M. Weis
(74) *Attorney, Agent, or Firm* — Brian T. Sattizahn; Maynard Nexsen PC

(57) ABSTRACT

A toe walking prevention device relates to an insert that is solid and includes an incline on the dorsal portion of the insert that rises from the proximal portion to the distal portion. The insert is configured to be used to prevent or treat toe walking by making it uncomfortable for a person to walk on his or her toes.

16 Claims, 5 Drawing Sheets

(56) References Cited

U.S. PATENT DOCUMENTS 2,878,153 A * 3/1959 Karl ..... B29C 66/00 264/DIG. 28
3,110,306 A * 11/1963 Posner ..... A61F 5/019 602/30
3,196,869 A * 7/1965 Scholl ..... A61F 5/019 D24/189
3,211,142 A * 10/1965 Neu ..... A61F 5/019 602/30
3,490,453 A * 1/1970 Ogden ..... A61F 5/019 604/293
3,550,593 A * 12/1970 Kaufman ..... A61F 5/019 604/23
3,736,673 A * 6/1973 Dubner ..... A43B 7/145 36/44
3,943,922 A * 3/1976 Umeda ..... A61F 5/019 604/293
4,351,324 A * 9/1982 Bronkhorst ..... A61F 5/0195 602/27
4,414,964 A * 11/1983 Farino ..... A61F 5/019 602/30
4,854,313 A * 8/1989 Kloepper ..... A61F 5/37 128/882
4,877,018 A * 10/1989 Ikebe ..... A61F 13/068 36/94
5,183,060 A * 2/1993 Shito ..... A61F 13/068 602/56
5,662,123 A * 9/1997 Goldman ..... A61B 5/225 600/595
5,939,339 A * 8/1999 Delmore ..... A61L 15/30 602/76
6,349,487 B1 * 2/2002 Hice ..... A43B 13/143 36/43
D489,458 S * 5/2004 Joseph ..... D24/192
6,743,189 B1 * 6/2004 Yan ..... A61F 5/05875 602/22
9,066,790 B1 * 6/2015 Fisher ..... A61F 5/019
10,638,814 B2 * 5/2020 Mancini ..... A43B 7/145
D922,590 S * 6/2021 Kersen ..... D24/192
11,327,565 B1 * 5/2022 Ribordy ..... G06F 3/0412
2006/0254092 A1 * 11/2006 Stevens ..... A43B 17/023 36/71
2008/0072455 A1 * 3/2008 Svae ..... A61F 5/019 36/88
2009/0301497 A1 * 12/2009 Bruckmann ..... A43B 7/00 602/5
2010/0100025 A1 * 4/2010 Kane ..... A61B 17/1322 606/203
2011/0283563 A1 * 11/2011 Ferri ..... A61F 5/019 482/79
2013/0079694 A1 * 3/2013 Aquino ..... A61F 5/019 602/30
2013/0318826 A1 * 12/2013 Nathaniel ..... A43B 17/14 36/97
2014/0068967 A1 * 3/2014 Jones ..... A43B 17/00 36/43
2014/0213954 A1 * 7/2014 Roth ..... A61F 5/019 602/30
2014/0316320 A1 * 10/2014 Bruckmann ..... A61F 5/013 602/22
2015/0020411 A1 * 1/2015 Castellano ..... A43B 7/145 36/71
2016/0044990 A1 * 2/2016 Georgeson ..... A43B 7/1445 36/43
2016/0295969 A1 * 10/2016 Mancini ..... A43B 7/145
2019/0104804 A1 * 4/2019 Taub ..... A43B 13/40
2020/0352279 A1 * 11/2020 Morrison ..... A43C 19/00
2021/0030105 A1 * 2/2021 Jackson ..... A43B 3/12
2021/0289881 A1 * 9/2021 Sugawara ..... A61F 5/14
2022/0160530 A1 * 5/2022 Hatto ..... A61F 5/0111
2024/0188681 A1 * 6/2024 Tillman ..... A43B 17/00
2024/0373977 A1 * 11/2024 Tillman ..... A43B 13/145

* cited by examiner

TOE WALKING PREVENTION DEVICE

CROSS-REFERENCE TO RELATED APPLICATIONS

This application is a continuation-in-part of U.S. patent application Ser. No. 18/080,572, entitled "TOE WALKING PREVENTION DEVICE" and filed on Dec. 13, 2022, which application is incorporated herein by reference.

BACKGROUND

The present application generally relates to a toe walking prevention device. More specifically, the present application is directed to a device that can be used with the footwear of a person to prevent or limit toe walking by the person.

A normal gait pattern for a person allows for one foot to perform "toe off" or rolling onto the ball of the foot while the other foot is taking the weight of the body. In a normal gait pattern, there is never a time when all the weight of the body should be on the ball of the foot. In contrast, a toe walking gait occurs when a person (typically a child) walks on the balls of their feet, with no contact between the person's heels and the ground. Toe walking is a habit that can develop when a child learns to walk. Some common causes for toe walking are leg weakness, calf tightness, a "short" Achilles tendon, sensory processing disorders, or vestibular issues. For example, a child having a "short" Achilles tendon may be physically unable to have his or her heel touch the ground. Toe walking can also be idiopathic, which means the cause is not known. In a small number of cases, persistent toe walking can be a sign of a more serious underlying medical condition, such as cerebral palsy, muscular dystrophy, a spinal cord abnormality or a neurological condition. Toe walking can have short and long term consequences for a child. Toe walking can lead to balance issues, foot pain, bone deformities, decreased motor skills, delays in milestones, social stigmas, decreased confidence and long-term conditions such as arthritis, weight gain, and foot injuries/surgeries.

Treatment of toe walking can vary. Nonsurgical treatments can include observation, serial casting or bracing (to stretch the muscles and tendons in the calves and encourage a normal gait) and/or Botox therapy (to deaden the calf muscle). In some cases, surgery may be required. For example, surgery may be performed to cut and/or lengthen the Achilles tendons of the child, which can improve the child's range of motion and allow for better function of the foot and ankle. In addition, physical therapy is often used after both nonsurgical and surgical treatments to help the patient learn to walk flat-footed more consistently. Many current treatments for toe walking can be invasive, uncomfortable and have decreased success rates and higher recurrence rates of toe walking in the future.

Therefore what is need is a less traumatic and more conservative and effective treatment for toe walking.

SUMMARY

The present application generally pertains to an insert used with footwear worn by a person (typically a child) to prevent or limit toe walking. The insert can be positioned between the ball of the foot and the base of the metatarsals of the foot of the person. The insert works by making it slightly uncomfortable for the person to put all of his or her weight on the ball of the foot, while still allowing for a comfortable normal heel-toe gait pattern. The insert can also provide a tactile cue to remind children to activate the correct muscles and get off their toes. Further, children who walk on their toes are typically seeking increased input and sensory feedback and by decreasing the surface area of their foot when toe walking, the child can receive increased proprioceptive input to their joint receptors. The insert can be located under the ball of the foot to provide a pressure input for those children who are sensory seekers without the need for those children to be on their toes.

The insert of the present application can prevent "toe walking" by preventing a person from placing all of his or her weight on the ball of the foot. The insert can be made of a rigid, dense material that has an incline extending from the proximal side (near the toes) to the distal side (near the heel). The proximal side can be placed at the ball of the foot and the tallest portion, the apex or the peak of the incline can be located at the base of the metatarsals. The highest portion of the insert (i.e., the peak, apex or tallest portion of the incline) can be aligned to the part of the foot that would bear all the weight when standing on the toes, thereby making it difficult and or painful to apply the body's weight to this part of the insert and causing one to stand and walk flat footed. In an embodiment, the plantar side of the insert can be detachably connected to the footwear by any suitable attachment technique (e.g., an adhesive strip). In other embodiments, the insert can be inserted into (and removed from) a sleeve formed in the insole of a shoe that aligns with the ball of the foot. In still other embodiments, the insert may be incorporated into and integral with the insole of a shoe such that the insert portion aligns with the ball of the foot.

An advantage of the present application is that is a simple and cost-effective treatment for toe walking.

Another advantage of the present application is that it provides a discreet treatment for toe walking that can have a positive impact on a child's self-esteem.

Other features and advantages of the present application will be apparent from the following more detailed description of the identified embodiments, taken in conjunction with the accompanying drawings which show, by way of example, the principles of the application.

BRIEF DESCRIPTION OF THE DRAWINGS

Wherever possible, the same reference numbers are used throughout the drawings to refer to the same or like parts.

DETAILED DESCRIPTION

The present application is directed to a toe walking prevention device. Toe walking is a pattern of walking in which a person, typically a child, walks on the balls of their feet with no contact between his or her heels and the ground. The toe walking prevention device can be placed near the vamp of a shoe, such that when the person places his or her foot in the shoe, the ball of the person's foot rests on the toe walking prevention device. The placement of the toe walking prevention device under the ball of the person's foot can result in discomfort that causes the person to not be able to walk on his or her toes, thereby forcing the heel of the person to the ground.

Figure 1A:
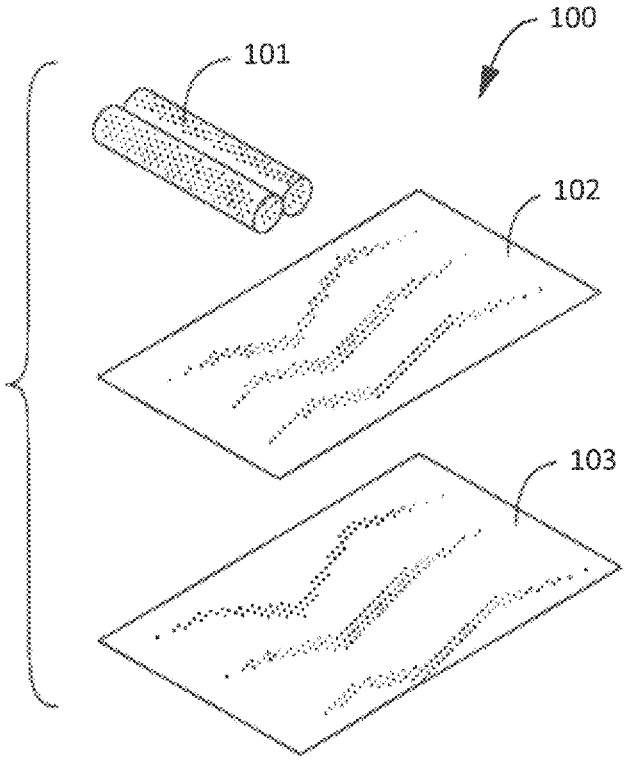
FIG. 1A is an exploded view of an embodiment of a toe walking prevention device.

FIG. 1A is an exploded view of a toe walking prevention device in accordance with one embodiment of the present application. The toe walking prevention device or insert 100 of FIG. 1A can include a base 101, one or more inner layers or wraps 102 and one or more outer layers or wraps 103. As shown in FIG. 1A, the base 101 can include two substantially cylindrical members placed next to one another or side-by-side. In other embodiments, the base 101 can be formed from a member or members having different geometrical shapes. The cylindrical members of the base 101 can be rods (e.g., pencils) or hollow tubes with sufficient rigidity such that the tubes do not collapse or deform under the weight of the person. The inner wrap 102 can be a thin, self-adherent (i.e., it can stick to itself), highly porous, translucent foam substrate (e.g., pre wrap) in one embodiment, but can be any suitable material in other embodiments. The outer wrap 103 can be a lightweight, self-adherent, porous, elastic wrap (e.g., Coban™) in one embodiment, but can be any suitable material in other embodiments.

Figure 1B:
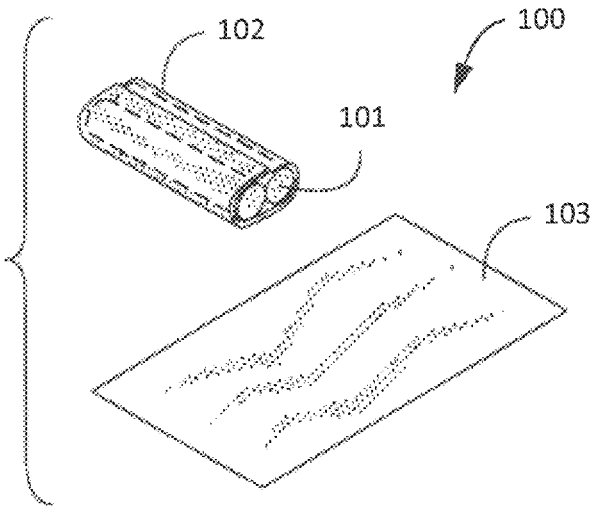
FIG. 1B is a partially exploded view of the toe walking prevention device of FIG. 1A.
Figure 1C:
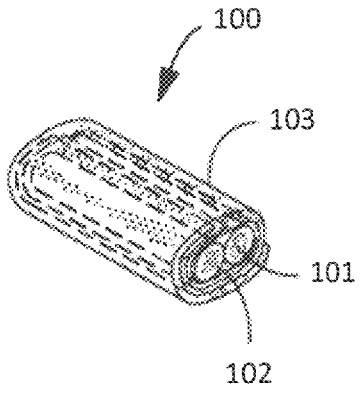
FIG. 1C is the assembled toe walking prevention device of FIG. 1A.

FIG. 1B shows the toe walking prevention device 100 with the cylindrical members of the base 101 being wrapped by the inner wrap 102 (a single inner wrap 102 is shown in FIG. 1B). The inner wrap 102 surrounds and holds the cylindrical members or the base 101 in position. FIG. 1C shows an assembled toe walking prevention device 103 with the cylindrical members of the base 101 being wrapped by both the inner wrap 102 (a single inner wrap 102 is shown in FIG. 1C) and the outer wrap 103 (a single outer wrap 103 is shown in FIG. 1C).

Figure 2:
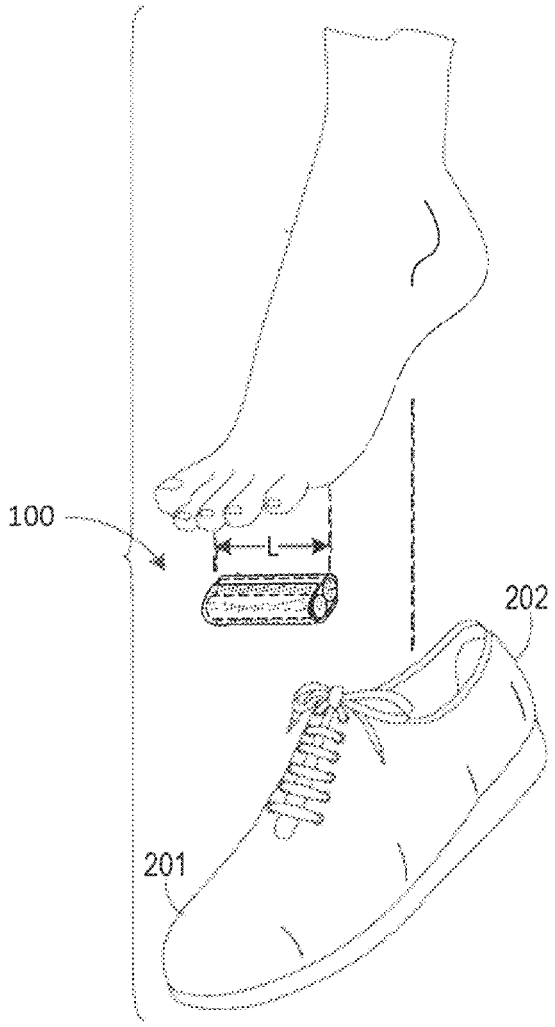
FIG. 2 is an exploded perspective view showing an alignment of a foot, the toe walking prevention device of FIG. 1C and a shoe.
Figure 3:
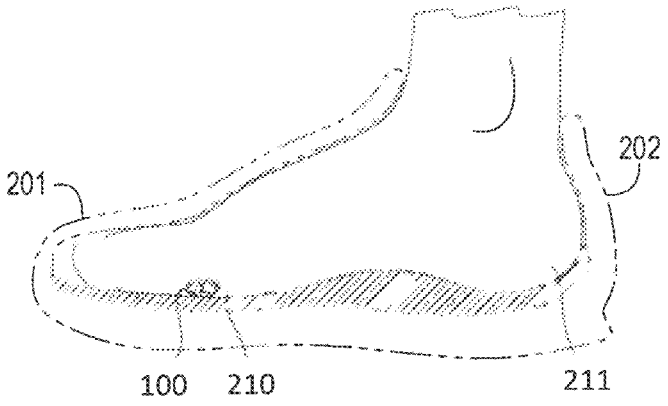
FIG. 3 is a side cut-away view showing the toe walking prevention device of FIG. 1C under the ball of the foot in a shoe.

FIG. 2 is an exploded view showing an embodiment of how the toe walking prevention device 100 can be installed in a shoe or other footwear. The toe walking prevention device 100 can be placed inside a shoe 202 approximately at the end of the toe box 201 near the shoe vamp. The length (L) of the toe walking prevention device 100 is approximately equal to the width of the toe box 201 in the shoe 202 such that the toe walking prevention device 100 can fit snugly in the toe box 201 of the shoe and secure the ball of the person's foot in an upward and curled position. FIG. 3 depicts the toe walking prevention device 100 in a shoe 202. The toe walking prevention device 100 rests on the bottom or sole of the shoe 202 at approximately the end of the toe box 201 near the vamp of the shoe 202 and in alignment with the ball 210 of the foot. The ball 210 of the foot can be supported by the toe walking prevention device 100 such that the toe walking prevention device 100 pushes upward on the ball 210 of the foot, which prevents the person from walking on his or her toes and ensures that the heel 211 of the foot touches the ground.

In one embodiment, an insole (not shown) of shoe 202 can be removed to make insertion of the toe walking prevention device 100 into the shoe 202 easier. In another embodiment, the toe walking prevention device 100 may be inserted on top of the insole of the shoe 202. In still other embodiments, an adhesive material may be used to secure the toe walking prevention device 100 in position within the shoe 202 and prevent the toe walking prevention device 100 from moving out of position when the foot is inserted in or removed from the shoe 202.

FIGS. 4-7 show different views of a toe walking prevention device in accordance with another embodiment of the present application. The toe walking prevention device 300 of FIGS. 4-7 can include a solid insert 302. The insert 302 can be manufactured from one or more of a plastic, polymer or composite material in one embodiment. However, in other embodiments, any suitable material(s) may be used to manufacture the insert 302. While the insert 302 is shown as solid in FIGS. 4-7, the insert 302 may contain one or more internal cavities (e.g., to reduce the weight of the insert 302). In one embodiment, the insert 302 can be made by additive manufacturing or three-dimensional (3D) printing techniques. However in other embodiments, the insert 302 can be made from other suitable manufacturing techniques (e.g., extrusion).

Figure 4:
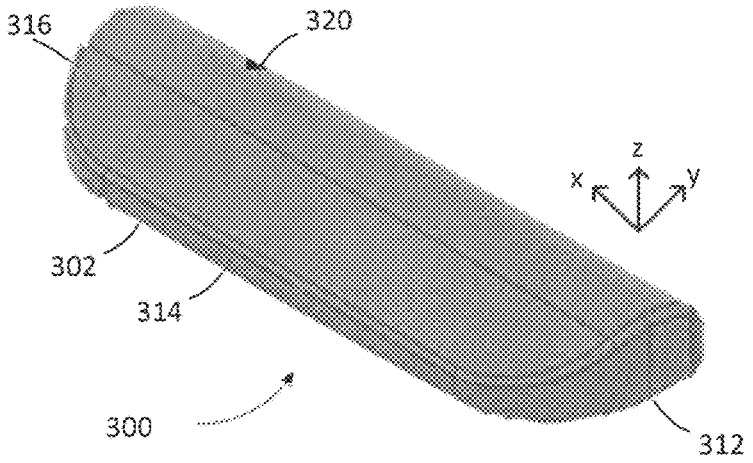
FIG. 4 is a perspective view of another embodiment of a toe walking prevention device.
Figure 5:
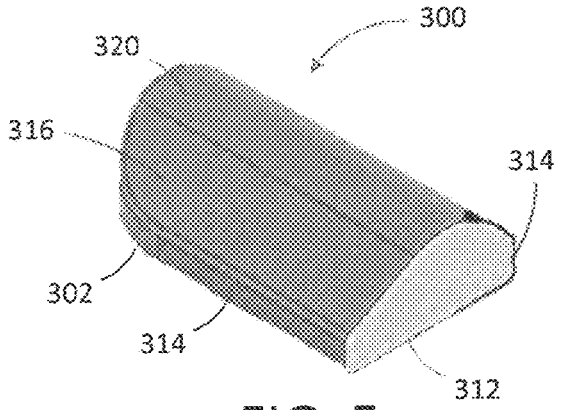
FIG. 5 is a cross-sectional view of the toe walking prevention device of FIG. 4.
Figure 6:
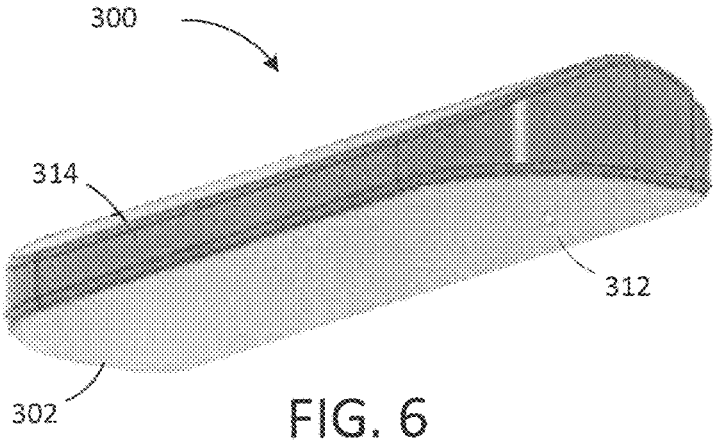
FIG. 6 is a bottom perspective view of the toe walking prevention device of FIG. 4.
Figure 7:
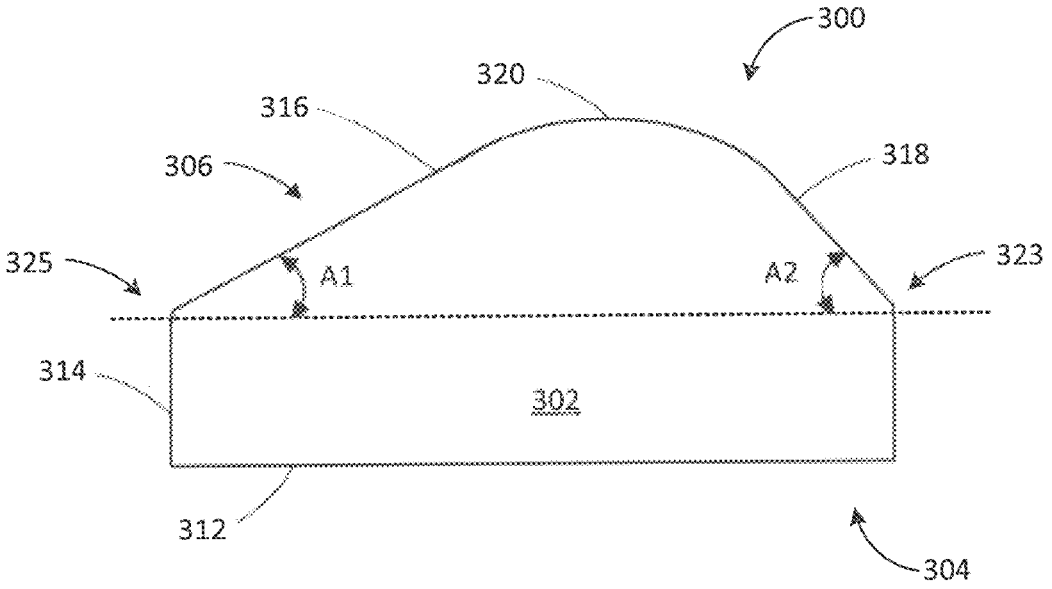
FIG. 7 is a schematic end view of the toe walking prevention device of FIG. 4.

The insert 302 can have a length (defined in the x-direction from FIG. 4), a width (defined in the y-direction from FIG. 4) and a height (defined in the z-direction from FIG. 4). As shown in FIGS. 4-6, the insert 302 can have curved or rounded longitudinal ends (i.e., the ends in the x-direction) and/or curved or rounded lateral ends (i.e., the ends in the y-direction. In addition, the insert 302 can have a lower (or plantar) portion 304 (see FIG. 7) and an upper (or dorsal) portion 306 (see FIG. 7). The lower portion 304 can include a base 312 to be positioned on the insole or bottom of the interior of a shoe or other footwear. The lower portion 304 can also include sidewalls 314 extending from the base 312 along at least a portion of the perimeter of the base 302. In one embodiment, the base 312 can have substantially planar base surface with the sidewalls 314 being substantially perpendicular to the base 312 and continuous along the perimeter of the base 312. In other embodiments, the base 312 may have one or more depressions in its surface (e.g., to reduce the weight of the insert 302) and the sidewalls 314 may be oriented at any suitable non-perpendicular angle (e.g., acute or obtuse) relative to the base 312 (e.g., for stability and/or manufacturing reasons). The sidewalls 314 can have substantially the same height (i.e., distance from the base 312) as shown in FIGS. 4-7, but, in other embodiments, the sidewalls 314 may have unequal heights (i.e., one sidewall 314 may be higher than another).

The upper portion 306 can be integral with the lower portion 304 and can include a first inclined portion (or surface) 316, a second inclined portion (or surface) 318 and a curved portion (or surface) 320 positioned between the first inclined portion 316 and the second inclined portion 318 and connecting the first inclined portion 316 and the second inclined portion 318. When the insert 302 is positioned in the shoe (see FIG. 8), the second inclined portion 318 can be located at end 323 of the insert 302 (in the y-direction) that is proximal to the toe box of the shoe and the first inclined portion 316 can be located at end 325 of the insert 302 (in the y-direction) that is distal to the toe box of the shoe. The transition between the sidewalls 314 and the first and second inclined portions 316, 318 can be rounded or curved in one embodiment, but other transition configurations can be used in other embodiments.

The first inclined portion 316 can be oriented at a first angle A1 (see FIG. 7) relative to a plane parallel to the base 312 and the second inclined portion 318 can be oriented at a second angle A2 (see FIG. 7) relative to a plane parallel to the base 312. The curved portion 320 connects the first inclined portion 316 and the second inclined portion 318 and provides for a smooth transition between the first inclined portion 316 and the second inclined portion 318. As shown in FIGS. 4-7, the apex of the curved portion 320 can be offset from the center of the base 312 (in the y-direction) resulting in the first inclined portion 316 extending for a greater distance than the second inclined portion 318. In other embodiments, the apex of the curved portion 320 can correspond to the center of the base 312 (in the y-direction) and the first and second inclined portions 316, 318 can have similar shapes such that angle A1 and angle A2 are substantially similar.

The first inclined portion 316 of insert 302 can have a downward slope (when travelling from the proximal end 323 to the distal end 325) at an angle A1 between 20° and 35° and in one embodiment can have an angle of 27.6°. The second inclined portion 318 of insert 302 can have an upward slope (when travelling from the proximal end 323 to the distal end 325) at an angle A2 between 40° and 55° and in one embodiment can have an angle of 47.5°. The length, width and height dimensions for the insert 302 can be dependent on the size of the shoe or other footwear that will be receiving the insert 302 (e.g., the length, width and height of the insert 302 for adult footwear will be greater than the length, width and height of the insert for children's footwear). When the insert 302 is to be placed in children's footwear, the insert 302 can have a height between 6 mm and 10 mm, a width between 10 mm and 25 mm and a length between 35 mm and 60 mm. In one embodiment, the insert can have a height of 7.9 mm and a width of 17.2 mm and a length that can correspond to the width of the toe box in the child's footwear. The curved portion 320, when the insert 302 is to be placed in children's footwear, can have a radius of curvature between 5 mm and 9 mm, and can be 7 mm in one embodiment.

Figure 8:
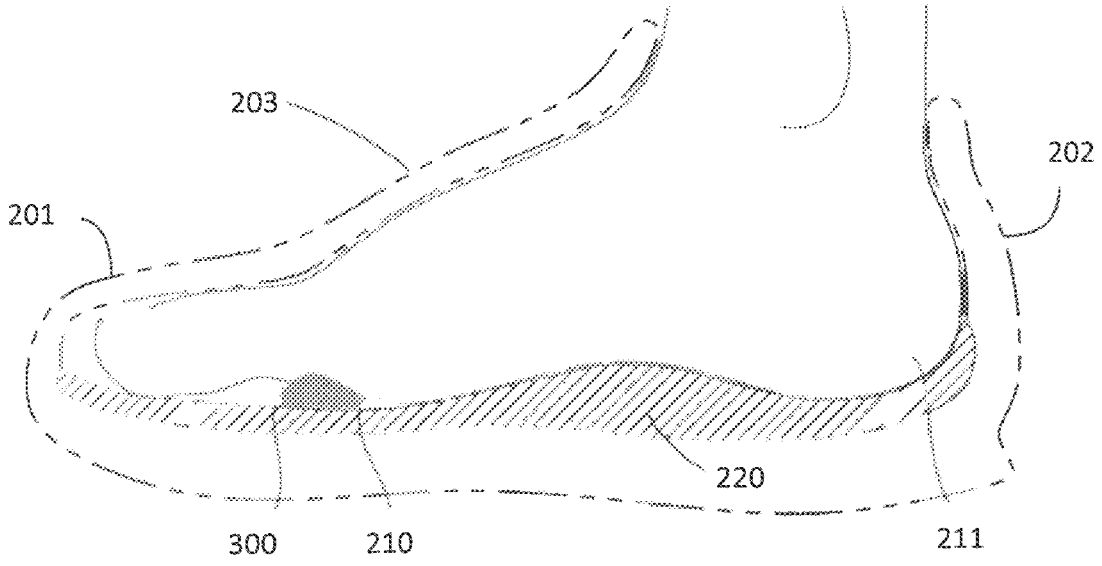
FIG. 8 is a side cut-away view showing the toe walking prevention device of FIG. 4 under the ball of the foot in a shoe.

FIG. 8 shows the toe walking prevention device 300 in a shoe 202. The toe walking prevention device 300 can be positioned on an insole 220 or upper surface of the sole of the shoe or footwear 202 (i.e., the surface of the sole intended to contact a person's foot). In another embodiment, the toe walking prevention device 300 can be positioned underneath the insole 220 of the shoe or footwear. The toe walking prevention device 300 can be positioned between the toe box 201 and the vamp 203 of the shoe such that the toe walking prevention device 300 is in alignment with the ball 210 of the foot. The ball 210 of the foot can be supported by the toe walking prevention device 300 and the toe walking prevention device 300 can push upward on the ball 210 of the foot to prevent a person from walking on his or her toes and to ensure that the heel 211 of the foot touches the ground.

Figure 9:
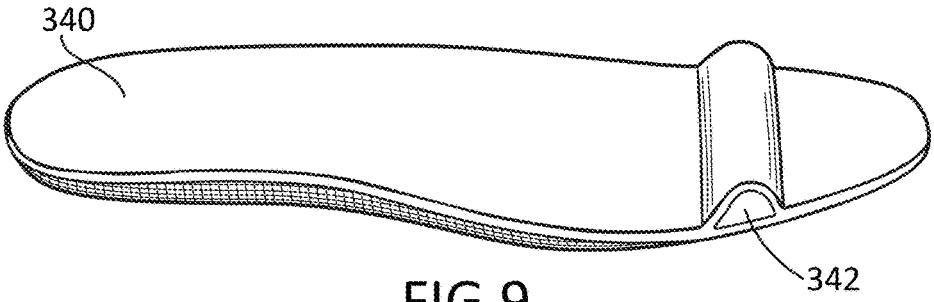
FIG. 9 is a side perspective view of an embodiment of an insole for a shoe with a sleeve that can receive the toe walking prevention device.
Figure 10:
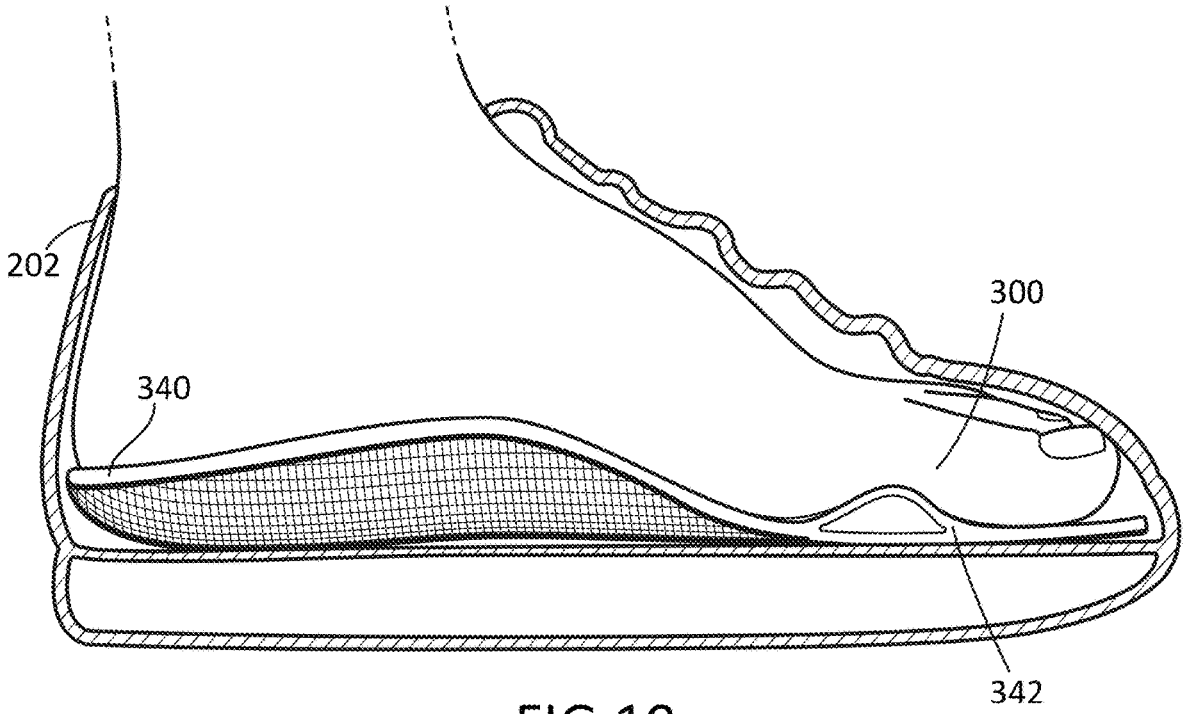
FIG. 10 is a side cut-away view showing the toe walking prevention device in a sleeve of an insole for a shoe.

In one embodiment, the toe walking prevention device 300 can be held in position in the shoe 202 using any suitable attachment technique or mechanism that connects the toe walking prevention device 300 to the insole 220 of the shoe 202, but still permits the toe walking prevention device 300 to be removed from the shoe 202. Suitable attachment techniques or mechanisms can include detachable adhesives, hook and loop connections or projections on the base 312 (e.g., prongs) that can engage with the insole 220 of the shoe 202 to hold the toe walking prevention device 300 in place. In other embodiments, as shown in FIGS. 9 and 10, the insole for the shoe can be arranged to hold the toe walking prevention device 300. FIG. 9 shows an insole 340 for a shoe that includes a sleeve 342 that can receive the toe walking prevention device 300. After the toe walking prevention device 300 is inserted in the sleeve 342, the insole 340 and the toe walking prevention device 300 can be inserted in the shoe 202 such that the toe walking prevention device 300 is located under the ball of a person's foot as shown in FIG. 10. In other embodiments, instead of the insole 340 having a sleeve 342 for the toe walking prevention device 300, the insole may have an integral portion that operates in the same manner as the toe walking prevention device. In other words, the insole of the shoe can incorporate a toe walking prevention device as part of the insole such that only the insole of the shoe has to be inserted into the shoe to prevent toe walking.

It should be understood that the identified embodiments are offered by way of example only. Other substitutions, modifications, changes and omissions may be made in the design, operating conditions and arrangement of the embodiments without departing from the scope of the present application. Accordingly, the present application is not limited to a particular embodiment, but extends to various modifications that nevertheless fall within the scope of the application. It should also be understood that the phraseology and terminology employed herein is for the purpose of description only and should not be regarded as limiting.

What is claimed is:

1. A device to treat or prevent toe walking, comprising:

an insert configured to be positioned in a shoe such that a ball of a person's foot contacts the insert upon the foot of the person being inserted into the shoe, wherein the insert has a proximal end and an opposed distal end relative to a toe box of the shoe upon the insert being positioned in the shoe and the insert comprises at least one inclined surface, an upper portion, a base, and a continuous sidewall, the at least one inclined surface being located along a dorsal portion of the insert and opposite a plantar portion of the insert relative to the insert when positioned in the shoe, the at least one inclined surface extending between the proximal end of the insert and the distal end of the insert, the at least one inclined surface having a first inclined surface along the upper portion of the insert and a second inclined surface along the upper portion of the insert, the first inclined surface and the second inclined surface connected by a medial surface that is rounded.

2. The device of claim 1, wherein the at least one inclined surface has one of an upward slope or a downward slope.

3. The device of claim 1, wherein the first inclined surface extends between the proximal end of the insert and the medial surface and has an upward slope.

4. The device of claim 3, wherein the first inclined surface has an upward slope between 40° and 55° relative to the base of the insert.

5. The device of claim 1, wherein the second inclined surface extends between the medial surface and the distal end of the insert and has a downward slope.

6. The device of claim 5, wherein the second inclined surface has a downward slope between 20° and 35° relative to the base of the insert.

7. The device of claim 1, wherein the base is configured to contact an insole of the shoe.

8. The device of claim 7, wherein the continuous sidewall extends substantially perpendicularly from the base.

9. The device of claim 8, wherein the insert includes a rounded transition from the sidewall to the at least one inclined surface.

10. The device of claim 1, further comprises means for fastening the insert to an insole of the shoe.

11. The device of claim 10, wherein the means for fastening comprises a detachable adhesive.

12. A toe walking prevention system, comprising:

an insole configured to be inserted into a shoe; and an insert configured to be positioned in the shoe adjacent to the insole such that a ball of a person's foot contacts the insert upon the foot of the person being inserted into the shoe, wherein the insert has a proximal end and an opposed distal end relative to a toe box of the shoe upon the insert being positioned in the shoe, and the insert comprises at least one inclined surface an upper portion, a base, and a continuous sidewall, the at least one inclined surface being located along a dorsal portion of the insert and opposite a plantar portion of the insert relative to the insert when positioned in the shoe, the at least one inclined surface extending between the proximal end of the insert and the distal end of the insert, the at least one inclined surface having a first inclined surface along the upper portion of the insert and a second inclined surface along the upper portion of the insert, the first inclined surface and the second inclined surface connected by a medial surface that is rounded.

13. The system of claim 12, wherein the insole comprises a sleeve configured to receive the insert.

14. The system of claim 12, wherein the insert is positioned on the insole or the insole is positioned on the insert.

15. The system of claim 12, wherein the first inclined surface extends between the proximal end of the insert and the medial surface and has an upward slope, and wherein the second inclined surface extends between the medial surface and the distal end of the insert and has a downward slope.

16. The system of claim 12, wherein the base is positioned in contact with the insole and the continuous sidewall extends substantially perpendicularly from the base.

* * * * *